United States Patent [19]

Smith

[11] 4,211,410

[45] Jul. 8, 1980

[54] SIMULATED FOOTBALL GAME

[76] Inventor: William Smith, 7724 Lucerne, Cleveland, Ohio 44130

[21] Appl. No.: 13,788

[22] Filed: Feb. 21, 1979

[51] Int. Cl.[2] ..... A63F 3/00

[52] U.S. Cl. ..... 273/94; 273/247

[58] Field of Search ..... 273/94, 247, 259, 277

[56] References Cited

U.S. PATENT DOCUMENTS

| | | | |
|---|---|---|---|
| 1,467,912 | 9/1923 | Atkins | 273/94 R |
| 1,654,582 | 1/1928 | Devine | 273/94 R |
| 2,205,415 | 6/1940 | Keely et al. | 273/94 R |
| 3,046,015 | 7/1962 | Schuh et al. | 273/94 R |
| 3,222,068 | 12/1965 | Cowels | 273/94 R X |
| 3,814,426 | 6/1974 | Moe | 273/94 R |
| 3,947,039 | 3/1976 | Sadler et al. | 273/94 R |
| 4,019,737 | 4/1977 | Witzel | 273/94 R |

FOREIGN PATENT DOCUMENTS

| | | | |
|---|---|---|---|
| 693586 | 9/1930 | France | 273/247 |

*Primary Examiner*—George J. Marlo

*Attorney, Agent, or Firm*—Woodling, Krost & Kurt

[57] ABSTRACT

This game has a game board which simulates a football field and has regularly spaced openings for receiving player pieces. Associated with the game board is a play selector with rotatably adjustable wheels located behind viewing windows and carrying indicia which designate, respectively, different types of plays, different directions in which the play may be run, and the identity of the ball carrier if the designated play is a run or the identity of the receiver if the play is a pass. The yardage of the designated play is determined by rolling dice. A separate manually operated chance device determines penalties, blocked kicks and incomplete passes.

9 Claims, 9 Drawing Figures

SIMULATED FOOTBALL GAME

SUMMARY OF THE INVENTION

This invention relates to a simulated football game which enables two opponents to simulate on a gameboard the play-by-play conduct of a football game.

In the presently-preferred embodiment this game comprises:

(a) a game board which presents a small-sized replica of a football field and has openings at suitable yard intervals both longitudinally and laterally of the playing field;

(b) simulated football player pieces which fit in these game board openings to show the positions of the offensive and defensive players at the beginning of each play;

(c) a play selector having a plurality of manually rotatable wheels behind respective viewing windows to display indicia which designate the next offensive play, its direction, and the identity of the ball carrier when the designated play is a run or the identity of the receiver when the designated play is a pass;

(d) a pair of dice which the offensive coach may throw to determine the yardage of the designated play and which both coaches may throw in special situations, as explained hereinafter;

and (e) a separate chance device in the form of a circular panel having sectors in succession circumferentially with legends which designate offensive and defensive penalties and blocked kicks or passes, and a rotatable pointer which may be spun by the offensive coach and permitted to come to rest pointing to a particular sector on the panel.

Preferably, the game also has manually changeable displays for indicating the down and yards to go for the team with the ball, and the scores of the two teams.

A principal object of this invention is to provide a novel board game which simulates the playing of a real game of football.

Further objects and advantages of this invention will be apparent from the following detailed description of a presently-preferred embodiment which is shown in the accompanying drawings.

DETAILED DESCRIPTION

Figure 1:
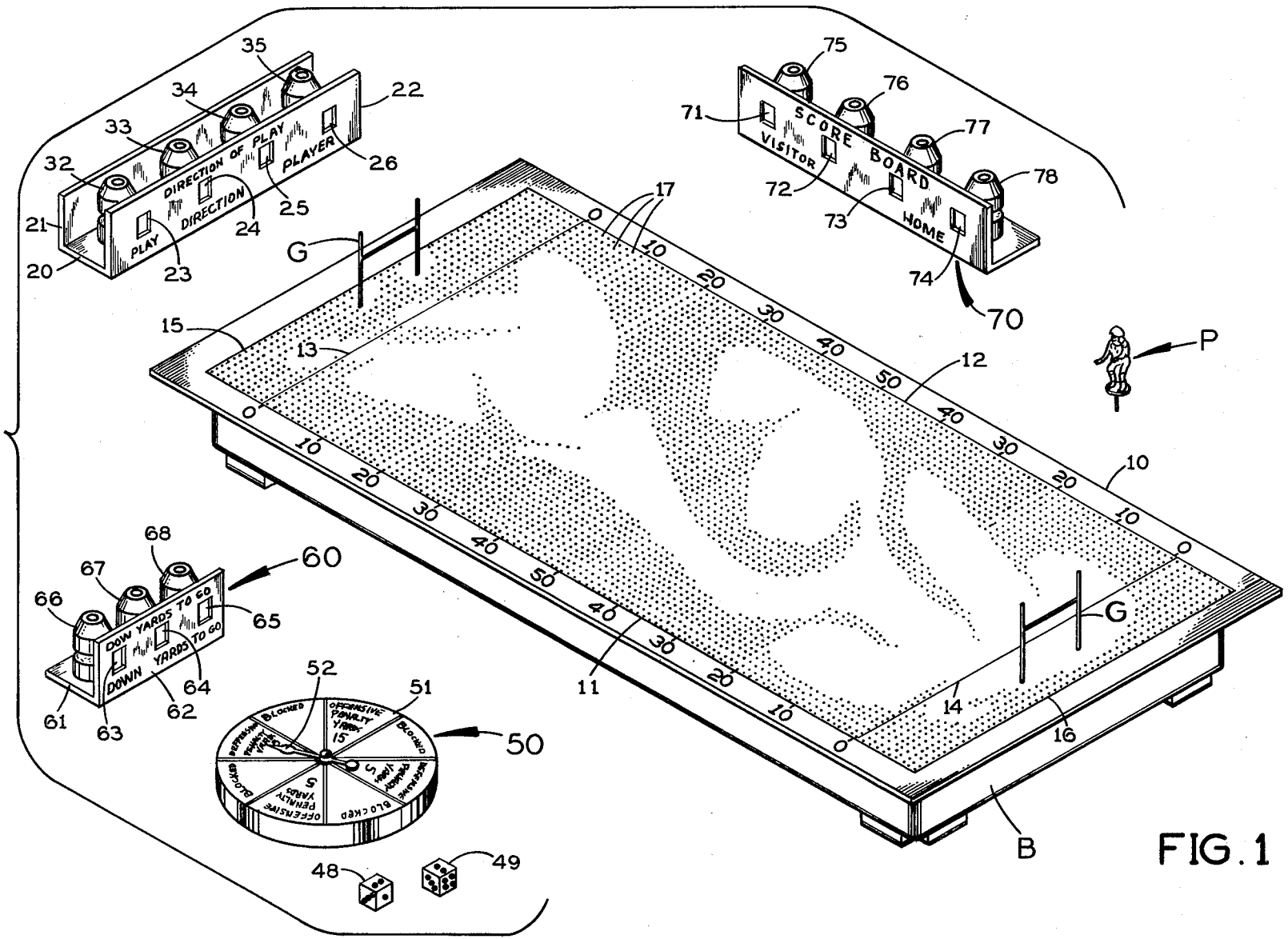
FIG. 1 is a perspective view showing the components of the present game, except that only one player piece appears.
Figure 3:
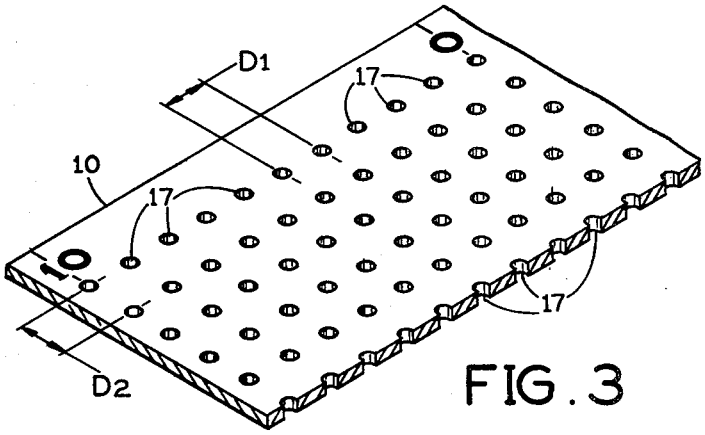
FIG. 3 is a fragmentary perspective view showing in enlarged detail part of the game board with its evenly spaced openings for receiving the player pieces.

Referring first to FIG. 1, the present game has a flat, rectangular game board 10 with visible lines which designate the opposite sidelines 11 and 12, goal lines 13 and 14, end zone lines 15 and 16, and yardlines at ten yard intervals along the field, so as to simulate in miniature the line markings on a football field. The game board 10 is formed with a plurality of vertical openings 17 at regular intervals, both longitudinally and laterally of the playing field and the end zones. These may be one-yard intervals (D-1 and D-2 in FIG. 3) or any chosen multiple or fraction of one yard intervals. The game board rests on a base B which may be rectangular in outline, as shown, or may be separate feet located at the opposite ends of the game board.

Figure 2:
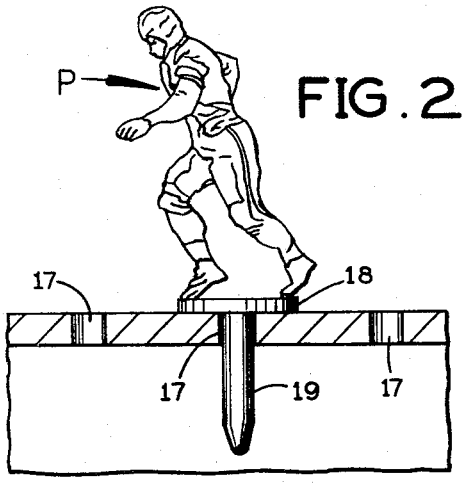
FIG. 2 is a fragmentary vertical section through the game board at the position of one player piece.

A plurality of player pieces P, which simulate individual football players, are manually insertable into and removable from these game board openings 17. As best seen in FIG. 2, each player piece P has a flat, circular, horizontal base 18 and a downwardly projecting pin 19 below the base. The pin is snugly received slidably in an individual opening 17 in the game board to position the base 18 of the player piece P contiguously overlying the top face of the game board. It is to be understood that twenty-two of such player pieces will occupy game board openings at one time, eleven making up the offensive team and the other eleven making up the defensive team.

The game is played by two opponents, each acting as the coach for the team made up of a set of eleven player pieces on the game board.

Figure 4:
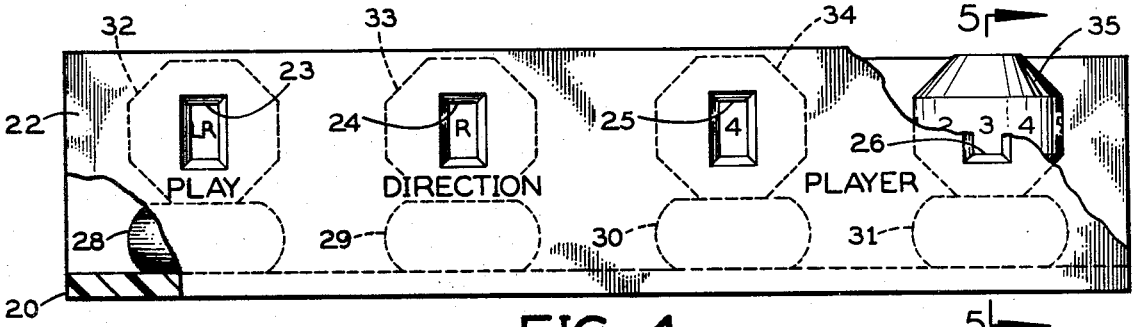
FIG. 4 is a front elevational view, with parts broken away for clarity, showing the novel play selector in the present game.
Figure 5:
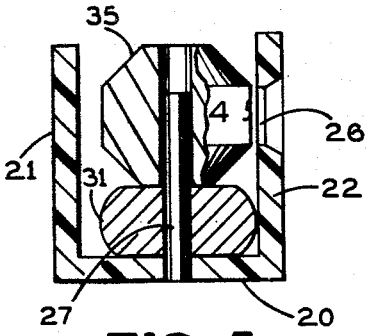
FIG. 5 is a vertical section through the play selector taken along the line 5—5 in FIG. 4.

The coach whose team has the ball operates a play selector as shown in FIGS. 4 and 5. This play selector has a framework with a flat bottom wall or base 20, a back wall 21 extending vertically up from the base 20, and a front wall 22 extending vertically up from the base 20 and spaced in front of the back wall. The front wall is formed with four relatively small window openings 23, 24, 25 and 26 (FIG. 4) at evenly spaced intervals from side to side.

Behind each opening a corresponding vertical pin 27 (FIG. 5) extends up from the base 20 midway between the front and back walls 22 and 21. Relatively thick spacer bushings 28, 29, 30 and 31 (FIG. 4) encircle these pins immediately above the bottom wall 20 of the framework. Respective selector wheels 32, 33, 34 and 35 overlie these spacer bushings and are freely rotatable manually on the respective upstanding pins 27. Each of these selector wheels carries letter or number indicia on its periphery for viewing through the respective window openings 23, 24, 25 or 26 in the front wall 22 of the framework.

Figure 6:
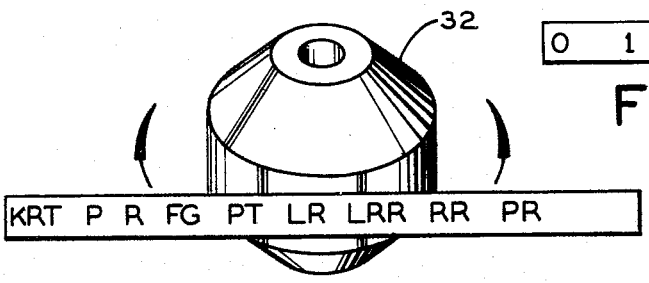
FIG. 6 shows in perspective the play selection wheel in the play selector, with the indicia band in this wheel shown in plan view.

As shown in FIG. 6, the first selector wheel 32 (near the left end in FIG. 4) carries the following play-indicating indicia in succession circumferentially on its periphery directly behind the window opening 23:

KRT — designating a kickoff return
P — designating a forward pass
R — designating a run
FG — designating a field goal attempt
PT — designating a punt
LR — designating a lateral followed by a run
LRR — lateral/reverse run
RR — reverse run
PR — pass reverse.

Figure 7:
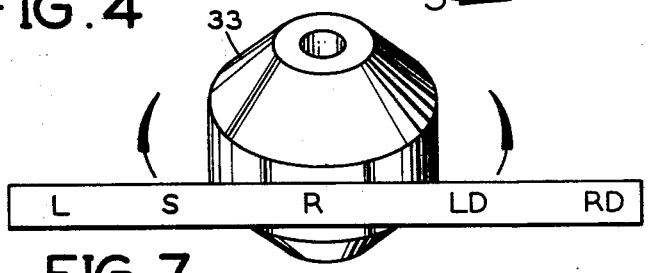
FIGS. 7, 8 and 9 are similar views of the play direction and the play identifying wheels in the play selector.

As shown in FIG. 7, the next selector wheel to the right in FIG. 4, wheel 33, carries the following play-direction indicia in succession circumferentially on its periphery directly behind the window opening 24:

L — to the left and then straight ahead
S — straight ahead

R — to the right and then straight ahead
LD — diagonally to the left and forward
RD — diagonally to the right and forward.

Figure 8:
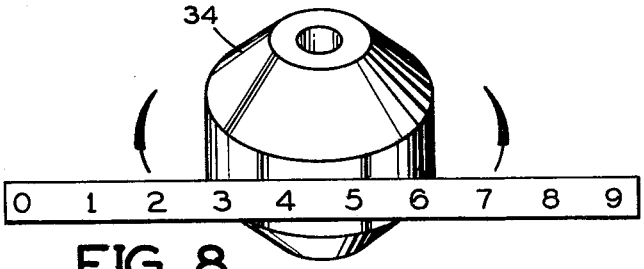

As shown in FIG. 8, the third selector wheel to the right in FIG. 4, wheel 34, carries the following numbers in succession circumferentially on its periphery directly behind the window opening 25 : 0, 1, 2, 3, 4, 5, 6, 7, 8 and 9. These numbers represent the tens digit of the number worn by the ball carrier, if the play is a run, or the intended receiver, if the play is a pass.

Figure 9:
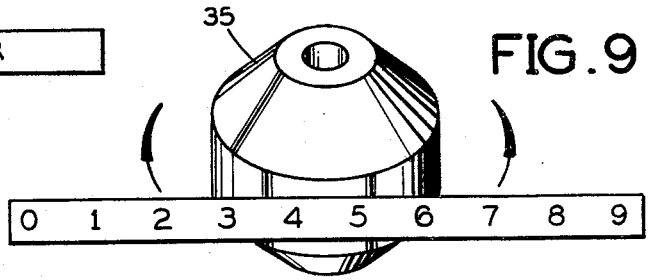

As shown in FIG. 9, the farthest selector wheel to the right in FIG. 4, wheel 35, carries the following numbers in succession circumferentially on its periphery directly behind the window opening 26 : 0, 1, 2, 3, 4, 5, 6, 7, 8 and 9. These numbers represent the units digit of the number worn by the ball carrier or pass receiver.

The offensive team's coach turns the selector wheels 32, 33, and 34 or 35 in succession to select the next play, its direction, and the player who will run the ball (if the play is a run) or who will receive the pass (if the play is a pass). It is to be understood that only one of the indicia on each selector wheel is visible at a time through the corresponding window opening 23, 24, 25 or 26.

The yardage of the selected play is determined by a pair of dice 48 and 49, which are rolled by the offensive coach after he has made the selections of the play, direction, and ball carrier or pass receiver.

Under certain circumstances the offensive coach operates the chance device shown at 50 in FIG. 1. This chance device comprises a flat circular panel 51 divided into eight sectors in succession circumferentially which carry the respective legends: "offensive penalty 15 yards"; "blocked"; "defensive penalty 15 yards"; "blocked"; "offensive penalty 5 yards"; "blocked"; "defensive penalty 5 yards"; and "blocked". A pointer 52 is rotatably mounted at the center of this panel and it may be spun manually by the offensive coach and permitted to come to a stop, pointing to one of the foregoing eight sectors.

Goal posts G extend up from the end zones of the playing field depicted on the game board to give added realism.

As shown in FIG. 1, a "down" and "yards to go" indicator 60 is provided which is essentially similar in construction to the previously described play selector. It has a support framework with a horizontal bottom wall or base 61 and an upstanding front wall 62 with three window openings 63, 64 and 65. Window 63 displays the number of the down being played. Windows 64 and 65 display the tens digit and units digit, respectively, of the yards to go. Respective wheels 66, 67 and 68 behind these openings carry numbers on their respective peripheries which are visible, one at a time, through the respective windows 63, 64 and 65.

A similar scoreboard arrangement is indicated generally by the reference numeral 70 in FIG. 1. It has two windows 71, 72 for respectively displaying the tens digit and the units digit of the visiting team's score, and two windows 73, 74 for respectively displaying the tens and units digits of the home team's score. Individual wheels 75, 76, 77 and 78 behind these windows are selectively rotatable to display at the windows the digits of these scores.

RULES OF PLAY

The following are suggested, but not mandatory, as some of the more important rules for playing a simulated football game with the present game apparatus.

Kickoff

The two teams are lined up on their respective 35 yard lines. The coach of the kicking team rolls the two dice, and advances one of his player pieces as many yards as the dice total. Next, the coach of the receiving team rolls the two dice and advances one of his player pieces as many yards as the dice total. Eventually, one of these players will pass the other on the field. The yard line where that player stops after passing the other becomes the line of scrimmage.

Run from Scrimmage

The offensive coach positions his player pieces on their side of the line of scrimmage and then operates the play selector while concealing from the defensive coach his (the offensive coach's) choice of play, play direction, and either ball carrier (if the play selected is a run) or receiver (if the play selected is a pass). After this has been done, the defensive coach, still without knowing the selections just made by the offensive coach, positions his player pieces on the opposite side of the line of scrimmage in a defensive alignment that he hopes will thwart the just-selected offensive play.

If a run has been selected, the offensive coach rolls the two dice, one at a time, and moves the designated runner in the designated direction of the play as many yards as the dice indicate from the position of the runner at the start of the play (i.e., behind the line of scrimmage).

If the designated run ends at the position of a defensive player piece on the board, then a fumble occurs. The two coaches now roll a single dice each, and the ball goes to the team whose coach rolled the higher number.

If the designated run intersects, but would not end, at the position occupied by a defensive player piece, then a tackle occurs at that position and that is where the ball is positioned for the next play. However, if any offensive player piece other than the ball carrier is ahead of the ball carrier and in line with the direction of the run, as determined by the play selector, that offensive player is considered a blocker who would have blocked the defensive player piece out of the way, and so the designated run is successful to completion. A successful run ends at the position determined by the runner's starting position, the dice total, and the designated direction of the play.

A straight-ahead run is selected by positioning the "S" on the play direction selector wheel 33 at the window opening 24 in the play selector (FIG. 4). Such a run simply involves moving the designated ball carrier forward as many yards as the total of the two dice.

An "L" run involves moving the ball carrier to the left as many yards as displayed by the first dice rolled, and then forward by the total of the two dice.

An "R" run involves moving the ball carrier to the right as many yards as displayed by the first dice rolled, and then forward by the total of the two dice.

"LD" and "RD" runs are diagonal runs forward and to the left or right, respectively, as determined by various combinations of the two dice. For example, the first dice rolled may tell the number of yards the run goes to the left or right, and the total of the two dice may give the total yardage forward.

On a lateral run "LR" or "RR" on the play selection wheel 32, the ball carrier is moved from his starting position to the left or right as many yards as the number on the first dice rolled by the offensive coach, then back to the right or left as many yards as the number of the second dice rolled, and then straight forward as many yards as the total score of the two dice.

Penalty

Before running the play, the offensive coach spins the pointer 52 of the chance device 50 and if it comes to rest at a "defensive penalty" sector, he then runs the designated play and either accepts the penalty or the outcome of the play, whichever is more advantageous to him. However, if the pointer 52 comes to rest at a "offensive penalty" sector, the designated play is run and then the defensive coach accepts the penalty or the outcome of the play, whichever is more advantageous to him. If the pointer 52 comes to rest at a "blocked" sector and the designated play is not a field goal, extra point or pass, then the play is run as above stated and the chance device 50 is ignored on this play.

Pass

If the designated play is a pass, the gross pass yardage is determined by rolling the dice twice and multiplying the total of the two rolls, except that six is the highest score allowed for the first roll. That is, any higher total than six on the first roll is computed as six when the total of the second roll is multiplied with it. From this gross pass yardage is subtracted the number of yards the designated receiver was behind the line of scrimmage at the start of the play. This gives the net yardage of the pass. The direction of the pass is determined, of course, by the play direction designated by the offensive coach.

In the case of a pass direction designated "R", "L", "LD" or "RD" on the play direction wheel 33, the path of the receiver is determined by the dice in the same manner as for the ball carrier when the designated play is a run.

After selecting the pass play, the offensive coach spins the pointer 52 of the chance device 50 and if it comes to rest pointing to a "blocked" sector on the panel, this means that the pass is incomplete.

If the designated receiver following the designated direction of the play goes out of bounds before completing the pass yardage indicated by the dice, this means that the pass is incomplete.

Also, the pass is incomplete if the pass yardage indicated by the dice would put the completion beyond the end zone line.

If the designated pass ends at a position on the game board occupied by one of the defensive player pieces, this means the pass is intercepted.

Punt

The punter is directly behind the ball and ten yards behind the line of scrimmage. The net yardage of the punt is determined the same way as the net yardage of a forward pass. The determination of whether a punt is blocked is made by having the coaches roll dice simultaneously. The punt is blocked only if they both roll the same number.

After a blocked punt the ball goes over to the defensive team at the same line of scrimmage.

Field Goal

The same rules apply as for a pass, except that whether a field goal is between the uprights is determined by having each coach roll a single dice. The field goal attempt is not between the uprights if the defensive coach rolls higher. Of course, even if between the uprights, the field goal attempt would also need enough yardage to be successful. The yardage and the blocking of a field goal are determined in the same manner as a pass.

Extra Point

The blocking of a point after touchdown effort is determined the same way as the blocking of a pass.

Additional rules may be devised for game situations other than those described above, and rules which differ from those just given may be adopted, if desired.

From the foregoing detailed description it will be apparent that the present game closely simulates the playing of an actual football game, especially in that the offensive coach has the advantage of being able to conceal from the defensive coach everything about the next play except the positions of the offensive player pieces. Accordingly, once the defensive coach has positioned his defensive player pieces, the initiative is with the offensive, just as it is in a typical football game. Therefore, the unique relationship between the play selector and the player pieces on the game board contributes greatly to the competitive enjoyment of the present game. To this are added several different elements of chance, involving the dice and the chance device 50 which come into play depending upon the particular game situation.

I claim:

1. In a simulated football game having:

a game board displaying a football field and having openings spaced apart at predetermined intervals both longitudinally and laterally of the field;

and a plurality of player pieces which are insertable in and removable from said game board openings to simulate football players making up offensive and defensive teams on the field;

the improvement which comprises:

a play selector having a plurality of manually changeable selection devices for designating respectively (a) any one of a plurality of possible plays by the offensive team;

(b) any one of a plurality of possible directions of the designated play on the playing field; and (c) any one of a plurality of players on the offensive team who will have the ball upon successful completion of the designated play;

and numerical chance means for determining the yardage of the designated play.

2. A game according to claim 1, wherein said selection devices in said play selector are manually rotatable wheels carrying indicia on their respective peripheries which designate the play, direction and player, respectively, and said play selector also comprises means rotatably supporting said wheels behind respective viewing windows which display one of the corresponding indicia at a time.

3. A game according to claim 2, wherein said play selector has a manually rotatable wheel carrying numbers on its periphery which designate the tens digit of the number of the designated player, and an additional manually rotatable wheel carrying numbers on its periphery which designate the units digit of the number of the designated player.

4. A game according to claim 1, 2 or 3 wherein said numerical chance means are dice.

5. A game according to claim 1, and further comprising a separate manually operable chance device having means for indicating an offensive or defensive penalty occurring on the designated play.

6. A game according to claim 5, wherein said separate chance device has means for indicating that an attempted pass is incomplete or that an attempted kick is blocked.

7. A game according to claim 8, wherein said separate chance device comprises a panel displaying different sectors in succession circumferentially which indicate penalties and blocks, and a rotatable pointer centermounted on said panel to point to one individual sector of the panel at a time.

8. A game according to claim 1, and further comprising a separate manually operable chance device having means for indicating that a pass attempt is incomplete.

9. A game according to claim 1, and further comprising a separate manually operable chance device having means for indicating that a kick designated as the play is blocked by the defensive team.

* * * * *